US005603522A

United States Patent [19]

Nelson

[11] Patent Number: 5,603,522

[45] Date of Patent: Feb. 18, 1997

[54] WIDE SHORT SKI

[76] Inventor: Paul N. Nelson, 21203 Poplar Way, Brier, Wash. 98036

[21] Appl. No.: 311,515

[22] Filed: Sep. 23, 1994

Related U.S. Application Data

[63] Continuation-in-part of Ser. No. 41,900, Apr. 2, 1993, abandoned, which is a continuation of Ser. No. 924,311, Aug. 3, 1992, abandoned, which is a continuation-in-part of Ser. No. 751,784, Aug. 29, 1991, abandoned.

[51] Int. Cl.[6] ..... A63C 5/04

[52] U.S. Cl. ..... 280/609; 280/601

[58] Field of Search ..... 280/609, 600, 280/601, 602, 11.2

[56] References Cited

U.S. PATENT DOCUMENTS

| | | | |
|---|---|---|---|
| 3,907,315 | 9/1975 | Charneck | 280/609 |
| 4,007,946 | 2/1977 | Sarver | 280/600 |
| 4,343,485 | 8/1982 | Johnston et al. | 280/609 |
| 4,652,006 | 3/1987 | Desoutter | 280/609 |
| 4,756,544 | 7/1988 | Abondance et al. | 280/609 |
| 4,778,197 | 10/1988 | Floreani | 280/602 |
| 4,895,388 | 1/1990 | Richmond | 280/607 |
| 5,096,217 | 3/1992 | Hunter | 280/609 |
| 5,286,051 | 2/1994 | Scherubl | 280/607 |

FOREIGN PATENT DOCUMENTS

| | | | |
|---|---|---|---|
| 439713 | 8/1991 | European Pat. Off. | 280/609 |

*Primary Examiner*—Eric D. Culbreth

[57] ABSTRACT

A wide short ski preferably has a length within the range of 148 to 173 centimeters, The forward, shovel portion of the ski has a maximum transverse width in the range of 110 to 120 millimeters. The ski also has a rearward, heel portion with a maximum width in the range of 105 to 115 millimeters. Both the shovel and tail portions taper into a narrower waist portion where ski bindings are mounted. The ski has symmetrical sidecuts in the range of 14 to 28 meters. The ranges just specified produce an optimized, energy-efficient ski for a broad range of snow conditions.

3 Claims, 5 Drawing Sheets

WIDE SHORT SKI

RELATED APPLICATIONS

This application is a continuation-in-part of U.S. patent application Ser. No. 08/041,900, abandoned, filed Apr. 4, 1993, which in turn is a file wrapper continuation of U.S. patent application Ser. No. 07/924,311, filed Aug. 3, 1992, now abandoned which in turn is a continuation-in-part of U.S. patent application Ser. No. 07/751,784, filed Aug. 29, 1991 now abandoned.

BACKGROUND—FIELD OF INVENTION

This invention relates to snow skis, and more particularly to an improved ski design utilizing an optimum combination of respectively wider and shorter than normal width and length dimensions.

BACKGROUND OF INVENTION

Skiing is a very physical sport, and consequently has typically attracted a younger following, whose physical energy is more abundant. Eventually, regardless of level of conditioning, expertise or passion for the sport, all skiers reach an age where the sport becomes more difficult, particularly in terms of sustained effort in a lengthy run, or in recuperation time after each run. As in any other sport requiring balance, skiing becomes more and more difficult as the skier becomes tired, due to loss of the ability to reflexively react to sudden changes in terrain or snow conditions and maintain proper balance equilibrium. These factors of slower reaction time due to fatigue, and lengthier recuperation times between or during runs eventually cause older skiers to lose their enjoyment of the sport. Additionally, both young and old initiates to the sport become discouraged due to the extra demands of energy typically required while learning to ski.

Conventional recreational skis have been traditionally designed with speed and maneuverability in mind on groomed snow as the prime criteria, with their lineage directly traceable to racing skis that have proven successful in Giant Slalom and Slalom. However, conventional designs appear to pay little regard to overall energy efficiency, particularly when encountering softer, ungroomed snow conditions—an important consideration in the design of a ski for the older skier, who has less discretionary energy.

Accordingly, a ski suitable for maximum energy efficiency in all snow conditions should possess the following characteristics.

First, the ski should possess the optimum range of load bearing surface area so as to float up in all types of snow conditions adequately.

Second, the ski should have enough length for directional stability at recreational speeds.

Third, the ski should have enough width, especially in the binding area, to provide a stable platform from which to reflexively react to sudden changes in terrain or snow conditions for maintaining balance equilibrium.

Fourth, the ski should be designed in a range of lengths so that less torsional resistance and rotational inertia, or swing weight, is encountered while making turns, particularly in turn initiation.

Fifth, the ski should be designed so that it will more easily initiate and execute a carved turn with less body english and unweighting movement.

BACKGROUND DESCRIPTION OF PRIOR ART

From the mid 1950's to the present, the technology relating to the manufacture of lighter, more durable skis using modern space-age materials has progressed dramatically. Present day skis are lighter in weight than their predecessors, averaging about 1800 grams per ski, for a representative 200 cm length ski, or about 9 grams per centimeter of length. This represents about a 15% to 20% lighter ski than what was commonly manufactured just 10 years ago, reducing the ski's swing weight by this same margin, a boon to the average skier and particularly the older skier. Irrespective of the advances made in ski construction, durability, dampening characteristics, weight reduction and flex design, very little has changed regarding the fairly narrow dimensional criteria of width and length used for alpine ski design. These dimensional criteria are quite consistent throughout the four main types of recreational skis sold, whether they be Giant Slalom, Slalom, mogul, or all-terrain. These approximate standards of dimensional criteria used by ski manufacturers are: shovel width, 85 mm±5 mm; waist width, 65 mm±5 mm; heel width, 75 mm±5 mm; and length, 170 cm to 210 cm.

These dimensions have had time-tested acceptance by the skiing public, and have set the standards for the minimum acceptable load-bearing surface area of an alpine ski. This area, bounded by points where the shovel and heel of the ski contact the snow, average about 1100 $cm^2$ for a 170 cm length ski, up to about 1400 $cm^2$ for a 210 cm length ski. The ski recommended as suitable for the greatest variety of snow conditions anticipated, such as groomed snow, powder, crud, heavy spring snow, etc., by the industry is generally sold as an all-terrain ski. The longer versions of these all-terrain skis are promoted as being more forgiving in soft snow conditions, hence more desirable. Unfortunately, the longer version of this ski, with its more desirable larger load-bearing surface area, carries with it an additional penalty of increased swing weight and torsional resistance.

By comparison, the swing weight of an industry standard 170 cm length all-terrain ski, given as rotational inertia about the pivot point, or ball of the skier's foot, is about 3.6 Newton meters squared, 47% less than the swing weight of 6.8 Newton meters squared of a 210 cm length version. Likewise, there is about 24% more torsional resistance for a 210 cm all-terrain ski than for a 170 cm version, where torsional resistance is computed directly from the contact length of the ski. This increase in the swing weight and torque has been acceptable to younger, more aggressive skiers who are willing and able to pay the price in terms of the extra energy requirements needed to operate these longer skis. In return they receive advantages that these longer skis give in flotation when skiing in areas of ungroomed snow.

For the older, more mature skier, these longer skis of lengths of 200 cm, 210 cm, or above are no longer an option in an all-terrain ski, due to their excessive energy demands. Ironically, the extra load-bearing surface area would be even more useful to the older skier, who typically is carrying a bit more weight than when he or she was younger.

Attempts have been made in the past to design an all-terrain ski that would initiate a turn easier, whether in groomed or ungroomed snow. These attempts have thus far been unsuccessful in meeting all of the criteria for an energy efficient design while maintaining at least the industry minimum accepted standard in load bearing surface area.

In the early 1970's, short skis were introduced to the skiing public by most of the alpine ski manufacturers, to try to recapture the interest of older, more mature skiers, and attract less experienced skiers and beginners. These skis were typically 20 cm shorter than the conventional length skis, ranging in length from about 150 cm to 190 cm. These skis were also a bit wider than conventional skis, averaging approximately 90 mm±2 mm at the shovel, 70 mm±2 mm at the waist and 80 mm±2 mm at the heel.

These skis required less torque and swing weight to overcome when initiating a turn, but fell short on load-bearing surface area, being only a few mm wider than conventional skis. A representative short ski of this period of 170 cm length would average about 1175 $cm^2$ of load-bearing surface area, or only about 75 $cm^2$ more than a conventional 170 cm length ski. Likewise, a representative 190 cm length short ski of this period would only give about 85 $cm^2$ flotation advantage over a 190 cm length conventional width ski of that period or the present day.

Other attempts have been made to solve the riddle of designing an energy efficient ski that will be useful in both groomed and ungroomed snow.

U.S. Pat. No. 4,007,946 (Sarver) 1977, teaches a short ski of about 90 cm to 110 cm in length, and about 100 mm to 115 mm wide at the shovel. This ski has a slight taper toward the heel, and no sidecut or waist. The boot is positioned so that only about 15 cm of ski projects behind the heel, or about 10 cm of running surface. It should be noted here that currently the shortest alpine skis used successfully by freestyle aerialists to reduce swing weight during twisting maneuvers, and that still have enough length for directional stability at in-run speeds are about 140–145 cm in length. The speeds that these aerialists reach on in-runs approaching their take off ramps approximates the upper end of speed that a proficient recreational skier will attain while skiing.

Sarver's (U.S. Pat. No. 4,007,946) ski, while possessing obvious advantages in torsional characteristics and swing weight due to its length, lacks about 30 to 35 cm of length in its longest version for directional stability, and would have limitations in top end speed. With about 950 $cm^2$ of load-bearing surface area in its longest version, Sarver's (U.S. Pat. No. 4,007,946) ski falls about 150 $cm^2$ short of possessing the industry accepted standard of minimum flotation.

With its lack of narrower waist area, Sarver's (U.S. Pat. No. 4,007,946) ski would also not initiate a carved turn, lacking the sidecut radius area designed into conventional skis enabling them to generate a natural curved arc in the snow when the ski is put on edge. Additionally, referring to the aforementioned aerial ski of 140–145 cm ski, this length is about the shortest ski successfully used by aerialist freestylers in part due to its contact length behind the skier's boot heel. In a 140–145 cm ski, this length is about 35 cm. This has proven to be about the minimum length of platform behind the skier's boot heel necessary for rearward balance equilibrium recovery in landing a jump. It can be seen that this minimum amount of platform contacting the snow behind the skier's boot heel, of 30–35 cm, is also a useful minimum for an adult recreational ski, especially in softer snow conditions, where the snow underfoot is not very firm.

Sarver's (U.S. Pat. No. 4,007,946) ski lacks this accepted minimum platform length of 30–35 cm, having only about 10 cm of contact length behind the boot heel.

Another solution proposed for designing a ski that would meet the criteria for an energy efficient all-terrain ski was put forth by U.S. Pat. No. 4,343,485, Johnston, et. al., 1982. Johnston's ski had a reverse camber to facilitate turn initiation, in a length range of 120 to 180 cm. This ski's main disadvantage is its reverse camber, reducing the ski's load-bearing contact length on the snow between 40 and 50%. As an example, a conventional 170 cm length ski has about 150 cm of contact length on the snow, giving it an effective tracking length at recreational speeds.

On the other hand, a 170 cm length preferred embodiment of Johnston's (U.S. Pat. No. 4,343,485) ski has but approximately 60 to 70 cm of contact length on the snow. The remainder of the ski's contact surface is angled slightly off the snow to the front and rear. This reverse camber effect in a 170 cm embodiment of Johnston's (U.S. Pat. No. 4,343,485) ski gives a contact length equivalent to a conventional ski of 80 to 90 cm overall in length, much too short for directional stability at recreational speeds. Thus it can be seen that U.S. Pat. No. 4,343,485, Johnston, et. al., solves the problem of torsional resistance in turn initiation only at the cost of directional stability due to loss of contact length. Johnston's (U.S. Pat. No. 4,343,485) ski has width dimensions equivalent to those of conventional skis, and thus does not improve on the load-bearing surface area ratio to length equation that exists in conventional skis.

U.S. Pat. No. 4,778,197, Floreani, 1988, discloses a ski less than 122 cm long, with a 102 mm shovel width, 76 mm waist width, and 100 mm heel width. This ski also has a forward hollow chamber filled with a flowable mass, and approximately 15 to 20 cm of load-bearing surface area behind the skier's boot. The first shortfall that Floreani's (U.S. Patent No. 4,778,197) ski has is its approximately 880 $cm^2$ of load bearing surface area, or about 220 $cm^2$ less than the industry accepted minimum. Secondly, this ski has approximately 15 to 20 cm less contact length behind the boot heel than is widely accepted as the minimum for rearward balance equilibrium recovery. Floreani's (U.S. Pat. No. 4,778,197) ski's forward flowable mass coupled with its rearwardly mounted boot also creates a major imbalance in swing weight fore and aft of the natural pivot point of the ball of the foot. This ski's total length of about 122 cm is also 18–23 cm short of what is accepted as the minimum length for directional stability at recreational speeds. Although Floreani's (U.S. Pat. No. 4,778,197) ski has a deep sidecut of about 10 m radius, the convex under-surface in the forward portion of his ski, combined with the angle of bending of the steel edge in the tail portion of the ski, and its relatively short contact length of approximately 100 cm would limit its effectiveness to that of slower recreational speeds, and soft snow conditions.

U.S. Pat. No. 4,895,388, Richmond, 1990, discloses a pair of skis with reversible sidecuts for use for both slalom and Giant Slalom racing that have removable stiffening plates. Richmond describes a sidecut on one side of the ski of sidecut radius range between 25 to 55 meters, and a range on the opposite side of sidecut radius 35 to 75 meters. The lower values of sidecut radius are designed to allow the ski to carve sharper turns more easily.

SUMMARY OF THE INVENTION

A wide, short ski in accordance with the invention, has a forward, shovel portion, and rearward, heel portion. A rearwardly tapering region of the shovel portion and a forwardly tapering region of the heel portion respectively come together to define a slightly narrower waist portion located in an intermediate region of the ski.

Preferably, in an all-terrain ski suitable for use in the broadest variety of snow conditions anticipated, the maximum transverse width across the shovel portion lies within the range of about 110 to 120 millimeters. The maximum transverse width across the tail portion is within the range of about 105 to 115 millimeters. In all cases, the waist portion narrows to a transverse width which is always less than the width of the shovel and heel portions, and is defined by symmetrical sidecut arcs between the shovel and heel portions. These sidecut arcs lie within the range of about 14 to 28 meters radius, and define a transverse width range across the waist portion of about 82 to 99 millimeters. The shovel width of the wide short ski should always be in the range of about 4 to 12 millimeters wider than the heel width of the ski.

The total length of the ski is defined by the combination of the shovel, waist and heel portions. Preferable, the total length is within the range of approximately 148 to 173 centimeters.

A ski constructed in accordance with the invention offers many advantages in stability, flotation and energy efficiency when compared to the prior art. The wide short ski meets the five basic design criteria necessary for optimum energy efficiency in an all-terrain ski.

First, the wide short ski possesses a range of load-bearing surface area ranging between about 1200 $cm^2$ and 1610 $cm^2$, in its range of length of 148 cm to 173 cm. This exceeds the minimum industry standard of about 1100 $cm^2$ for a 170 cm length conventional ski. At the wide short ski's upper limit of about 1610 $cm^2$, of load-bearing surface area, the conventional ski's surface area of about 1400 $cm^2$ is far exceeded, giving the wide short ski in its longer versions a tremendous advantage in flotation over conventional skis, and all of the referenced prior art.

Second, the wide short ski possesses enough length for directional stability at recreational speeds, in its length range of 148 to 173 cm, being longer in its shortest embodiment of 148 cm than the industry proven minimum of 140 to 145 cm in length as previously discussed.

Third, the wide short ski has enough width, especially in the binding area, to provide a stable platform from which to reflexively react to sudden changes in terrain or snow conditions in order to maintain balance and equilibrium. With its waist width range of approximately 82 to 99 mm, the wide short ski possesses a width under the skier's boot that most closely approximates the width of the human foot, which is itself a time-tested optimum width for maintaining balance equilibrium wile in motion. It is the applicant's experience through prototype testing and evaluating of different width embodiments of the wide short ski that a width of approximately 99 mm is the approximate upper boundary for the waist of the ski. At a 99 mm waist width, with transversely centered bindings, boot top cuff pressure in modern, high cuff boot remains in a comfortable range.

At the narrowest waist width of about 82 mm, the applicant has found that the effective feedback of side to side roll adjustment and edge pressure, modified by the overall load-bearing surface area, remains advantageous. Below this 82 mm waist dimension, the benefits of edge pressure sensitivity and overall balance and platform roll resistance begin to taper off due to excessive loading in grams per $cm^2$ of surface area under the skier's boot. For this reason, it has been applicant's experience that the lower limit of waist width for the wide short ski should not fall below about 85 mm for the shortest, or approximately 148 cm, embodiments, where there is less total load-bearing surface area to modify the square area loading directly under the skier's boot.

As the length of the wide short ski embodiments range upward in length, toward its maximum length of about 173 cm, the lower limit of waist width of about 82 mm can be approached, with its platform roll resistance being modified more by the ski's overall loadbearing surface area. For example, the optimum lower limit of waist width for a 148 cm length embodiment, as discussed earlier, is about approximately 85 mm; for a 153 cm length embodiment, about 84 mm; for a 158 cm embodiment, about 83 mm; and for 163 to 173 cm lengths, about 82 mm.

By way of comparison, U.S. Pat. No. 4,007,946, Sarver, discloses a ski with a width in what would be its waist location of between approximately 90 to 105 mm. While this ski possesses an optimum waist width in its narrowest embodiment, it does not have the total load-bearing surface area necessary to allow effective use of this platform width in softer snow, as a result of its high sink rate due to lack of overall flotation capacity.

U.S. Pat. No. 4,343,485, Johnston, et. al., 1982, discloses a ski with a waist width of about 69 mm, far less than the minimum width that the applicant has found to be useful for a stable platform under the skier's boot, in an all-terrain ski.

U.S. Pat. No. 4,778,197, Floreani, 1988, does not meet the criteria for minimum waist width disclosed by the applicant, having at about 76 mm, 9 mm less waist width than the preferred minimum platform width under the skier's boot for the shortest embodiment of applicant's invention. Floreani's (U.S. Pat. No. 4,778,197) ski's shortfall in waist width is also compounded by its lack of minimum load-bearing surface area, having about 220 $cm^2$ less than the industry accepted minimum for an adult skier. As in the ski disclosed by U.S. Pat. No. 4,007,946, Sarver, 1977, Floreani's ski does not have adequate enough total load-bearing surface area to modify the loss of edge pressure sensitivity in softer snow conditions resulting from its high sink rate due to its lack of overall flotation capacity, and resultant high weight per $cm^2$ loading of this waist area.

U.S. Pat. No. 4,895,388, Richmond, 1990, discloses a ski patterned after conventional racing skis, which have an average waist width of about 65 mm. This ski has the same drawbacks that conventional skis have, which is a shortfall of about 17 mm of width from what applicant has found to be the lower limit of advantageous platform width in the waist area when skiing in softer snow conditions. This narrow a platform width of 65 mm does not provide enough edge sensitivity or feedback for efficient balance equilibrium adjustments in softer snow conditions, particularly in the transition period between turns.

Likewise, the short skis of the early 1970's, with an average waist width of only 5 mm or so wider than conventional alpine skis, or about 70 mm, still falls far short of the minimum waist width found to be effective by the applicant when encountering softer snow conditions.

The average overall platform width of the wide short ski, which is calculated by combining the waist and shovel widths and waist and heel widths and dividing by four, ranges from about 96 to 107 mm in its shortest length embodiments, to about 95 to 107 mm in its longest embodiments. This average overall platform width range, modified by the approximate industry standards of torsional flex and longitudinal flex, gives the wide short ski a very distinct, comfortable "feel", especially on softer snow. For reference, the current industry standards for torsional flex and longitudinal flex, which have varied little, if any in the last 10 years are: for torsional flex, a range of approximately 0.8 to 1.6 N-m/degree, and for overall longitudinal flex, about 32 to 46 N/cm. The wide short ski employs approximately these same industry tested standards of flex criteria in its various embodiments.

Not coincidentally, this average platform width of the wide short ski, modified by its torsional and longitudinal flex parameters, and its range of load-bearing surface area, approximates very closely the "feeling" of having a fairly solid and stable surface to balance on, even in soft snow. The "feel" that the wide short ski has is fairly similar to the "feel" of a comfortable walking or running shoe, having a very similar width of effective balance platform. This natural "feel" that the wide short ski has is a major contributory factor in how quickly the average older skier can adapt to the extra width of the ski, and how much easier it is for them to ski in ungroomed snow than before with conventional width skis, or how easy it is for them to ski ungroomed snow if they had never done so previously.

U.S. Pat. No. 4,007,946, Sarver, 1977, discloses a ski with an average width of about 95 to 105 mm, which is a good "feel" in width for a ski. However, as discussed previously, this ski falls far short of the minimum accepted load-bearing surface area necessary to prevent an excessive sink rate in softer snow conditions, negating the benefits of its extra width.

U.S. Pat. No. 4,778,197, Floreani, 1988, discloses a ski with an average width of about 88.5 mm, or about 7.5 mm narrower than the narrowest preferred embodiment of the wide short ski, with a resultant lack of solid "feel" on the snow, particularly in soft snow.

U.S. Pat. No. 4,343,485, Johnston, et. al., 1982, and U.S. Pat. No. 4,895,388, Richmond, 1990, share with conventional skis and short skis of the 1970's an average platform width of about 72.5 mm to 77.5 mm, or about 18 mm less average width than the wide short ski has in its narrowest version. Obviously these skis are not going to "feel" as solid underfoot, particularly in soft snow.

The fourth characteristic that an energy efficient all-terrain ski should have is a range of length that reduces torsional resistance and swing weight, particularly in turn initiation, while at the same time conserving load-bearing surface area.

It has been applicant's experience in prototyping and in limited production of the wide short ski, that the previously mentioned 9 grams per centimeter of length that the average conventional all-terrain ski weighs is also quite reasonably achieved in the design of wide short skis, while maintaining acceptable flexural and structural standards.

This translates into a tremendous saving of torsional resistance and swing weight when comparing the wide short ski of equal or greater load-bearing surface area to conventional width skis.

For example, a representative embodiment of the wide short ski of about 165 cm length and average width of approximately 100 mm, with shovel, waist and heel dimensions of approximately 115 mm, 90 mm, and 105 mm, respectively, has about 1420 $cm^2$ of load bearing surface area. A 210 cm length conventional all-terrain ski of standard dimensions of shovel, waist and heel of approximately 85 mm, 65 mm and 75 mm, respectively, has about 1365 $cm^2$ of load-bearing surface area. This conventional ski has about 6.8 Newton meters squared of swing weight, or about twice as much as the 165 cm version of the wide short ski, which has about 3.3 Newton meters squared of swing weight about the ball of the skier's foot. Likewise the torsional difference between these two skis are marked, with the conventional 210 cm ski having about 31% more torsional resistance than the 165 cm wide short ski.

Similar disparities in swing weight and torsional resistance are readily apparent when comparing embodiments of the wide short ski with skis of comparable load-bearing surface area as disclosed in U.S. Pat. No. 4,343,485, Johnston, et. al., 1982, and U.S. Pat. No. 4,895,388, Richmond, 1990, as well as short skis popularized in the early 1970's.

Both U.S. Pat. No. 4,007,946, Sarver, 1977, and U.S. Pat. No. 4,778,197, Floreani, 1988, have low swing weights and torsional resistance; however, these skis have unbalanced swing weights and unbalanced torsion due to their rearwardly placed bindings. In the case of Floreani's (U.S. Pat. No. 4,778,197) ski, this imbalance is 'further magnified by a flowable mass forward of the boot toe which is calculated to give a swing weight of about 3 Newton meters squared, without 90% of this rotational inertia forward of the pivot point at the ball of the foot, making for a very unbalanced ski. By comparison, both conventional skis and the wide short ski typically have their respective centers of gravity within a couple centimeters of the ball of the skier's foot.

The torsional and swing weight values of U.S. Pat. No. 4,007,946, Sarver, 1977, and U.S. Pat. No. 4,778,197, Floreani, 1988, are not compared to those of embodiments of the wide short ski, due to their substandard amount of load-bearing surface area. When compared to the minimum industry standard, they fall short by 150 $cm^2$ and 220 $cm^2$, respectively. The fact that this industry standard is about 100 $cm^2$ below the smallest load-bearing surface area of the shortest wide short ski embodiment does nothing but makes them less comparable.

The fifth characteristic that an energy efficient ski should have is a deep enough sidecut radius so that the ski will initiate and execute a carved turn with a minimal amount of body english and unweighting movement.

The wide short ski, with its preferred sidecut radius range of between 14 and 28 meters, is ideal for making fairly short turns at recreational speeds. Preferably, this sidecut radius ranges between about 10 and 16 times the ski's overall length. These deep sidecut radii permit the wide short ski to initiate a carved turn at a lower initial angle of inclination off the snow surface.

U.S. Pat. No. 4,007,946, Sarver, 1977, does not employ a sidecut radius in its ski.

U.S. Pat. No. 4,343,485, Johnston, et. al., employs a sidecut of less than 28 meters only in its 135 cm or less length embodiments, less than the industry standard acceptable adult length for a ski. Interestingly, Johnston does not even make full use of this deeper sidecut, or even his larger sidecut radii effectively, negating the advantage of a deeper sidecut with his "reverse camber", reducing the normally desirable edge contact length as the ski is put on edge.

U.S. Pat. No. 4,778,197, Floreani, 1988, discloses a ski that has a sidecut radius of approximately 10 meters, or about 33% less than the deepest sidecut cited as preferable by the present applicant.

Floreani (U.S. Pat. No. 4,778,197), too, does not make full and effective use of the deep sidecut he employs in his embodiment, beveling the steel edge severely at the tail so it won't bite as hard and shaping a convex base into the forebody of the ski. Both of these additional preferred adaptations sacrifice a great deal of the advantageous edge grip that a deep sidecut provides, and are at best contradictory in design.

On the other hand, the wide short ski makes full and effective use of the deep sidecuts that are preferred as part of applicant's invention, with a sharp edge running the full length between shovel and heel being the norm.

It is well known in the industry that conventional alpine skis, including all-terrain skis, have sidecut radii that are symmetrical and range from about 40 to 60 meters in length of radius. Below about 40 meters in sidecut radius, it has been found that a conventional ski of racing length, or between 190 and 210 cm, becomes hard to correct directionally, having too much torsional resistance and swing weight to overcome in making quick enough directional adjustments when minor irregularities in the snow are encountered by these harder carving edges, which cause them to swerve more dramatically than a more gentle sidecut version of the same ski would.

Only the wide short ski, with its dramatically reduced swing weight and torsional resistance, along with its more reasonable preferred recreational speeds, can advantageously handle the deep, symmetrical sidecut radii that are preferred as part of the applicant's design.

U.S. Pat. No. 4,895,388, Richmond, 1990, describes a pair of skis with asymmetrical sidecuts, with one sidecut being between 25 and 55 meters in radius, and the opposite being between 35 and 75 meters in radius, ostensibly to provide reversible skis useful for both Slalom and Giant Slalom racing.

For reasons already given above regarding conventional length and width racing skis, which it can reasonably be assumed that Richmond's (U.S. Pat. No. 4,895,388) ski's design improves upon, a sidecut radius of 25,30 or even 35 meters in radius on a racing length ski would be very hard to control, and hence inefficient directionally. Further, if Richmond's (U.S. Pat. No. 4,895,388) ski were to employ a 25 meter radius on one side of his ski, and a 35 meter radius on the opposite side, employing the industry standard 85 mm and 75 mm shovel and heel widths, respectively, the transverse width at the waist area where bindings are normally mounted would be reduced to about 50 mm, or 10 mm less than what is considered in the industry as the bare minimum binding mounting width.

If Richmond's (U.S. Pat. No. 4,895,388) ski were to be made 10 mm wider overall to increase the binding area width, it would become too bulky to compete with state-of-the-art Giant Slalom racing skis.

Thus it can be seen that while attempts have been made in the past to try to solve the equation of designing an all-terrain ski which meets the five basic criteria for energy efficiency, only the wide short ski fully satisfies these five criteria in its unique combination of width, length and sidecut.

BRIEF DESCRIPTION OF THE DRAWINGS

In the drawings, like reference numerals and letters refer to like parts throughout the various views, and wherein.

List of Referenced Numerals

Figure 1:
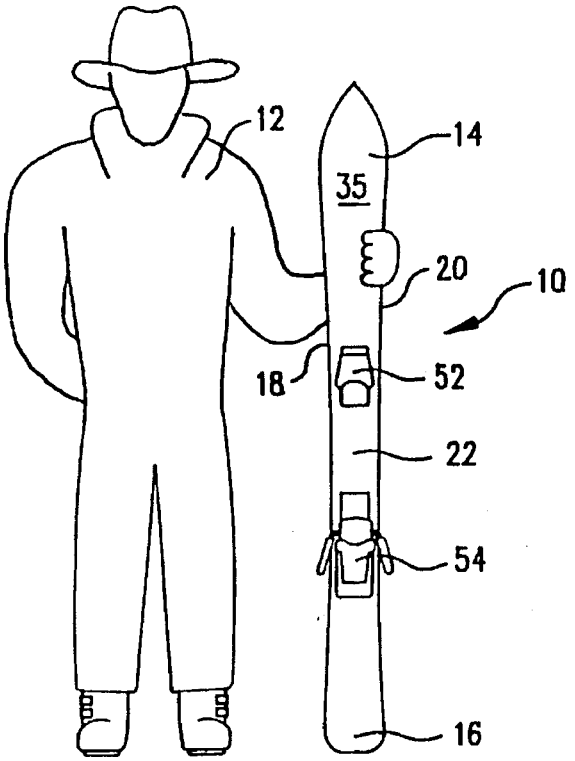
FIG. 1 is a silhouette of a skier holding one of two wide short skis in accordance with one preferred embodiment of the invention.

10 embodiment of wide short ski
12 silhouette of skier
14 shovel portion
14A rearwardly tapering portion
16 heel portion
16A forwardly tapering portion
18 left side edge
20 right side edge
22 waist portion
24 narrowest portion of waist region
26 forward contact point
28 tip
30 rear contact point
32 end
34 bottom surface
35 top surface
36 base material
38 interior core wrap
40 lower layer reinforcing material
42 upper layer reinforcing material
44 interior core
46 sidewall
48 sidewall
50 reinforcing layer
52 toe binding
54 heel binding
56 ball of foot
58 mid cord point
60 center of gravity point
62 boot heel
64 side cut deflection
66 boot toe
68 ski boot
70 edge contact length
72 base contact length

BEST MODE FOR CARRYING OUT THE INVENTION

Figure 2:
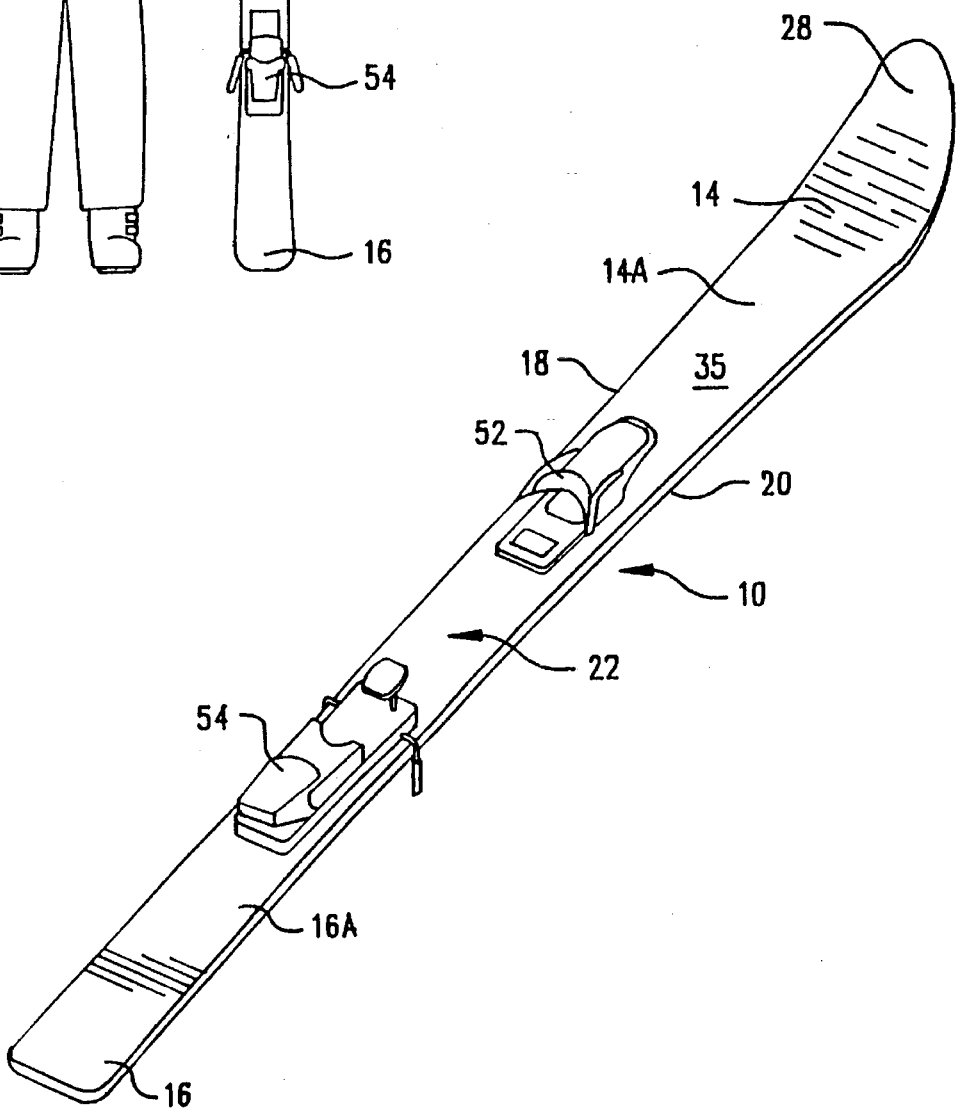
FIG. 2 is a perspective view of the ski shown in FIG. 1.

Referring now to the drawings, and first to FIG. 1, shown generally at 10 is a wide short ski constructed in accordance with a preferred embodiment of the invention. The ski 10 as shown in FIG. 1 is being held vertically relative to a skier 12, in order to give the reader the proper perspective as to the dimensions of the ski. Although only one ski 10 is shown in FIG. 1, it should be presumed that the skier would use two skis constructed along the lines of the single ski shown. Referring now to FIG. 2, other than having certain unique dimensions which will further be described below, the ski 10 is otherwise conventional in construction.

It has a forward, shovel portion, 14, and a rearward, heel portion, 16. The shovel portion 14 has a rearwardly tapering region 14A which converges into the waist portion 22. Likewise, the heel portion 16 has a forwardly tapering region 16A which also converges into waist portion 22. The tapering regions 14A, 16A essentially define the location and width of the waist portion 22.

Figure 4:
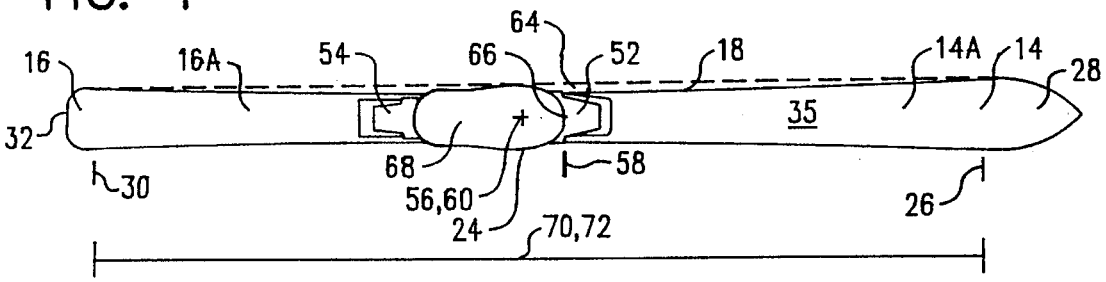
FIG. 4 is a top view of the ski shown in FIG. 2 and 3.
Figure 5:
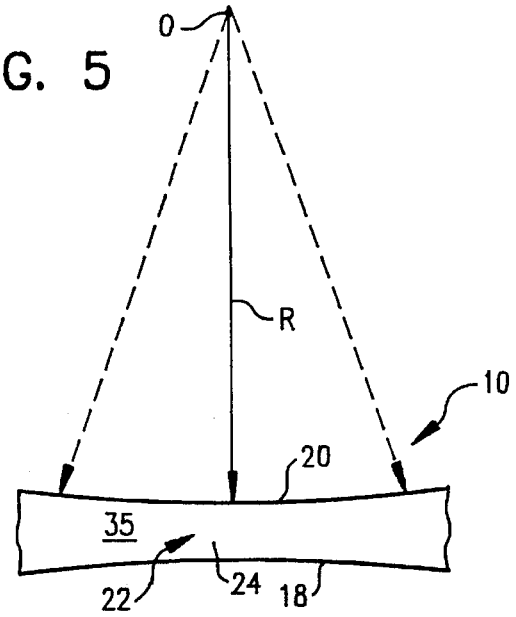
FIG. 5 is a schematic, fragmentary view of the waist portion of the ski shown in FIGS. 2 through 4, and illustrates how the lateral edges of such portion are defined by symmetric arcs having a certain sidecut radius.

The rearward and forward tapered regions 14A, 16A just described are defined by geometric arcs of a certain sidecut radius. Referring to FIG. 5, for example, the side edges 18, 20 of the ski symmetrically follow an arc defined by a certain radius R which mathematically originates at 0. The location at which the edges 18, 20 are the closest together defines the narrowest location across the waist portion 22 of the ski. Such location is generally indicated by arrow 24 in FIGS. 4 and 9. This location 24 is generally located within a few centimeters of the mid point between the forward contact point 26, and the rear contact point 30. For optimum results, the sidecut radius R should be in the range of approximately 14 to 28 meters, and fall in the range of about 10 to 16 times the overall length of the particular embodiment. In other words, a 148 cm length embodiment of the invention will have a sidecut radius R ranging between about 14.8 to 23.7 meters. Similarly, a 173 cm length embodiment of the invention will have a sidecut radius R ranging between about 17.3 to 27.7 meters.

Figure 3:
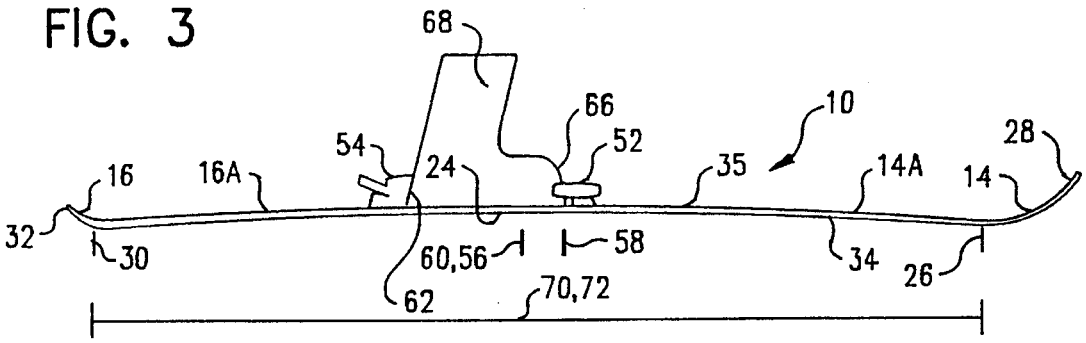
FIG. 3 is a side view of the ski shown in FIG. 2.

The total length of the ski 10 is defined by the combination of heel, waist, and shovel portions, 16, 22, 14 extending from one end of the ski to the other. Referring to FIG. 3, for good performance, the maximum length of the ski 10 should be within the range of approximately 148 to 173 centimeters. The transverse width across the shovel portion 14 should be within the range of about 110 to 120 millimeters. The transverse width across the tail portion should be about 105 to 115 millimeters.

Within the ranges specified above, there may be certain optimum dimensions that are better-suited for different skiing conditions. For example, FIGS. 3 and 4 illustrate what the inventor considers to be optimum dimensions for a ski for general purpose use where the majority of the skier's time would be spent on groomed snow, with occasional forays into soft, ungroomed snow. There, the length of the ski is approximately 165 centimeters, with the upward camber of the ski extending approximately 142 centimeters from the forward contact point 26 where the ski's tip 28 curves upwardly to the rear contact point 30 where the ski's end 32 curves upwardly. The tip 28 and end 32 are respectively approximately 18 centimeters and 5 centimeters in length. The transverse width across the shovel 14, waist 22, and heel 16 are about 112, 82 and 105 millimeters respectively. The sidecut radius R of this particular embodiment is approximately 19 meters. This particular ski would be suitable for use in a broad range of snow conditions, from well groomed slopes to deep powder, being most useful if the majority of the skiing were to be done on groomed snow.

A wider version of the embodiment cited above, with the shovel 14, waist 22, and heel 16 dimension of about 120, 90 and 113 millimeters, respectively, for example, would be most useful if the majority of the skiing were to be done on ungroomed snow, with occasional excursions into groomed snow.

Generally, the shorter versions of the wide short ski are most useful for skiing in restrictive terrain, such as chutes, or in treed slopes, where very quick turns are a requirement for maximum control of the skier's descent. Here again, the widest embodiment of the inventor within the width ranges given is recommended if ungroomed snow skiing is to be in the norm, with the narrowest embodiment of the invention recommended if groomed terrain is to be expected in these restrictive areas.

If recreational speeds approaching those generally achieved during a typical slalom race, or about 35 to 43 miles per hour, and are the norm for the end user, an embodiment of the invention designed toward the upper end of its length range is recommended. Again, within the width range cited, a wide short ski for use mostly on groomed snow should have a waist dimension approaching its minimum recommended width, with its sidecut radius more toward the upper end of the cited range for that length. In this case of ski of 173 cm length with shovel 14, waist 22, and heel 16 approximate widths of 110, 87.5, and 105 mm respectively is most preferable, this ski remains quite useful on ungroomed snow, and deep powder, with approximately 1537 $cm^2$ of load-bearing surface area.

It is possible, within the ranges of length, shovel, waist and heel widths and sidecut radius to vary the design of the invention to optimize the performance of the ski in accordance with the skier's own specific needs and style of skiing, and retain the inherent energy efficient advantages that the ski possesses.

Figure 6:
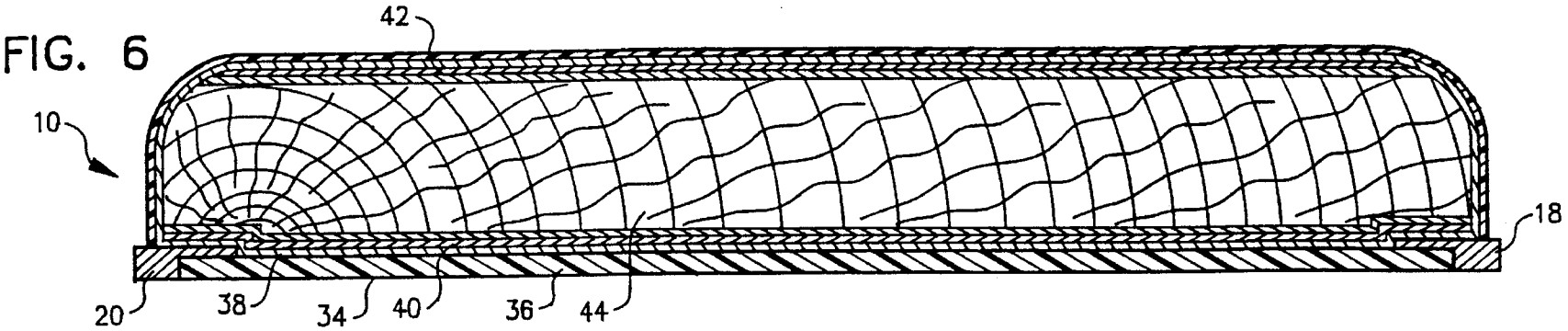
FIG. 6 is a transverse, cross-sectional view of one embodiment of the ski shown in FIGS. 2 through 4.
Figure 7:
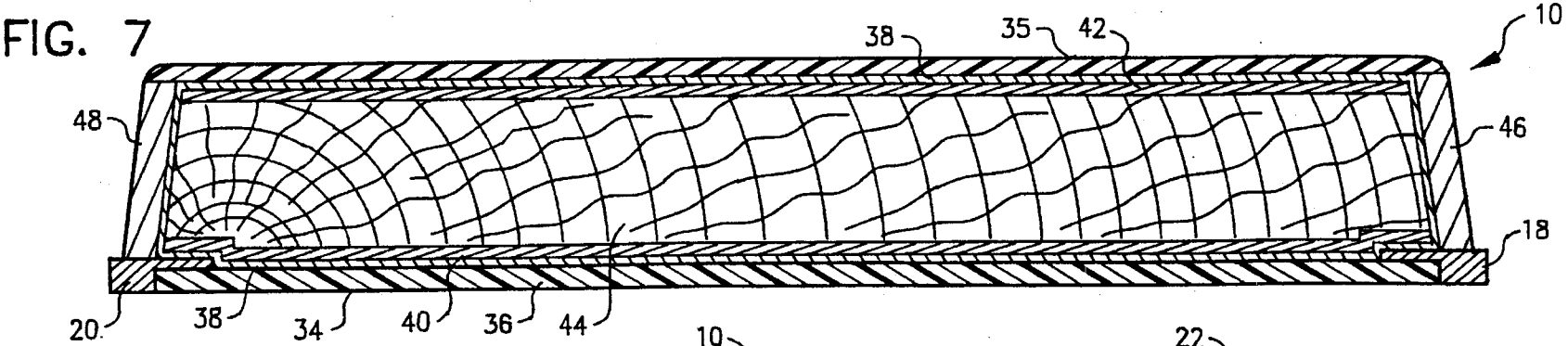
FIG. 7 is a view like FIG. 6, but is for another embodiment of the ski.
Figure 8:
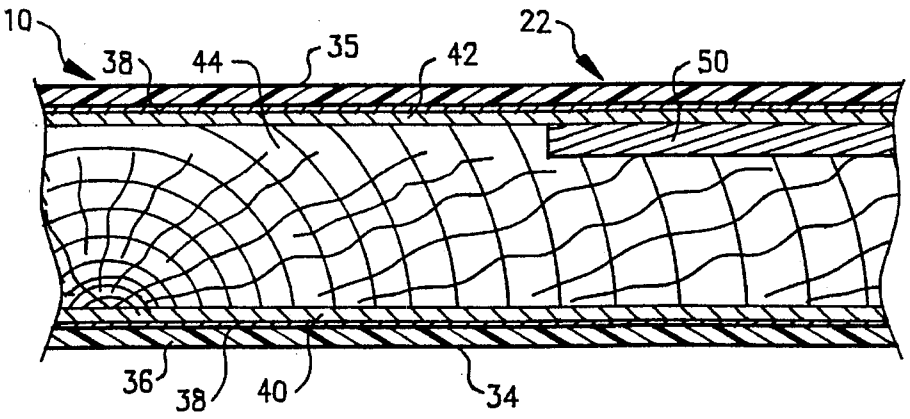
FIG. 8 is an enlarged, fragmentary, side cross-sectional view of a portion of the ski shown in FIGS. 2 through 4, and illustrates the internal construction of one embodiment of the ski at a location where a binding is mounted thereto.

FIGS. 6–8 illustrate the internal construction of the ski 10. One embodiment is shown in FIG. 6. Directing attention there, the bottom surface 34 of the ski is defined by a layer of a conventional base material 36, such as P-Tex™ or other currently manufactured state-of-the-art materials made for the running surface of the ski. The ski's side edges 18, 20 are made of steel, which is also of conventional material. Reinforcement is provided by an interior core wrap 38, preferably made of a fiberglass matrix within an epoxy. However, it could also be made of plastic, aluminum, steel or other high-strength material. Reinforcement is also provided by upper and lower layers, 40, 42 of a reinforcing material such as unidirectional fiberglass, steel, titanium alloy, aluminum alloy, Kevlar™ etc. Inbetween the reinforcing layers 40, 42 is an interior core 44, which can be made of wood, foam core, honeycomb, etc. or combinations of such materials. All of these elements are bonded together by epoxy.

The embodiment shown in FIG. 7 illustrates another type of construction. FIG. 7 primarily differs from FIG. 6 in that it has a different sidewall construction. There, the top surface 35 of the ski is straight across, and is interconnected to the side edges 18, 20 by straight sidewalls 46, 48. These sidewalls may be made of any number of conventional materials.

FIG. 8 is a lengthwise, cross-sectional view showing a region in the waist portion 22 of the ski. There, the ski should preferably have an underlying reinforcing layer 50 of fiberglass, aluminum alloy, titanium alloy, steel, etc. The purpose of such layer 50 is to provide reinforcement in areas of the ski where binding screws are to be used for mounting ski bindings to the ski 10.

As is shown in FIGS. 2, 3 and 4, the ski 10 has conventional toe and heel bindings 52, 54 mounted to its top surface 35. As is well-known, such bindings 52, 54 are used to releasably engage the toe and heel of a skier's boot. In preferred form, the toe binding 52 is mounted so that the toe of the skier's boot 66 is positioned within a couple of centimeters of half the distance between the tip 28, of the ski 10 and the end 32, of the ski 10. This distance is generally known as the mid cord point 58.

Using an industry average of about 32 centimeters for an adult length ski boot 68, the ball of the foot 56 lies about 10 centimeters rearward of the boot toe 66. For comparative purposes, the ball of the foot 56 is coincidental with the logitudinal center of gravity point 60 of the ski 10. In actual embodiments of the invention, as well as in conventional skis, the ball of the foot 56, and the center of gravity point 60 of the ski 10 lay within a few centimeters of each other.

in FIGS. 3 and 4 the edge contact length 70 is the distance between the heel portion 16 and the shovel portion 14, at their widest respective locations. The base contact length 72 is shown in the ski 10 in FIG. 3 as being coincidental with the edge contact length 70 of the ski 10, shown in FIGS. 3 and 4, also for reasons of comparative analysis between the ski of the present invention and skis of the prior art.

Comparative Analysis of Mechanical Characteristics of Ski of Present Invention and its Advantages over Cited Prior Art References, Using Previously Described Dimensional Criteria.

The following graphs plot various combinations of design parameters of the wide short ski for comparison against accepted design parameters of cited prior art skis, using the following basic formulas:

For swing weight, or rotational inertia, $I_R = 1/12\ mL^2$, where m=mass, L=length. For comparative purposes the pivot point of the ski is taken to be at point 56, 60 in FIG. 3 in the drawings. These results will be given in $Nm^2$, or Newton meters squared. As discussed earlier, the weight per unit length for all skis calculated will be standardized at 9 grams per centimeter of length, or 0.0098 Newtons per centimeter of length.

This point 56, 60, for ease of evaluation, should be considered as being located similarly in conventional skis; in U.S. Pat. No. 4,343,485, Johnston, et. al., 1982; in U.S. Pat. No. 4,895,388, Richmond, 1990; and in short skis of the 1970's. Also, for ease of evaluation, this pivot point 56, 60 will be considered as the approximate mid point of the overall length of the skis being compared.

The formula for torsional resistance, or torque, T, will be calculated directly from the edge contact length 70, shown in FIG. 5. The edge contact length for the prior art skis being evaluated will similarly be calculated. These results will be given in Nm, or Newton meters, where N will be considered to be a constant, for comparison purposes, of one-half of an average adult male skier's weight, or about 400N.

The formula for load-bearing surface area, as discussed previously in the specification, will be calculated by multiplying the various cited ski's edge contact length by its average width.

As explained previously, the various cited ski's average widths will be calculated by adding the transverse widths of shovel and waist, and heel and waist, and dividing this sum by four. This will be given in millimeters. The load-bearing surface area will be given in $cm^2$, or centimeters squared.

All of the above cited formulas should be understood as being used to calculate various values for one ski only, which would normally be used in a pair.

Table I represents a brief comparison of a conventional 210 centimeter length all-terrain ski, and a 165 centimeter length embodiment of the ski of the present invention, in about its mid range of preferred width.

TABLE I

| | conventional width 210 cm all-terrain ski | 165 cm embodiment of present invention |
|---|---|---|
| average platform width | 72.5 mm | 101 mm |
| load-bearing surface area | 1355 $cm^2$ | 1434 $cm^2$ |
| torsional resistance | 748N | 568N |
| swing weight (rotational inertia) | 6.78 $Nm^2$ | 3.3 $Nm^2$ |

As can easily be seen in Table I, the ski of the present invention has a platform width 39% greater than the conventional ski, over 50% less swing weight, and 24% less torsional resistance than the conventional ski cited, and more than comparable load-bearing surface area.

Figure 9:
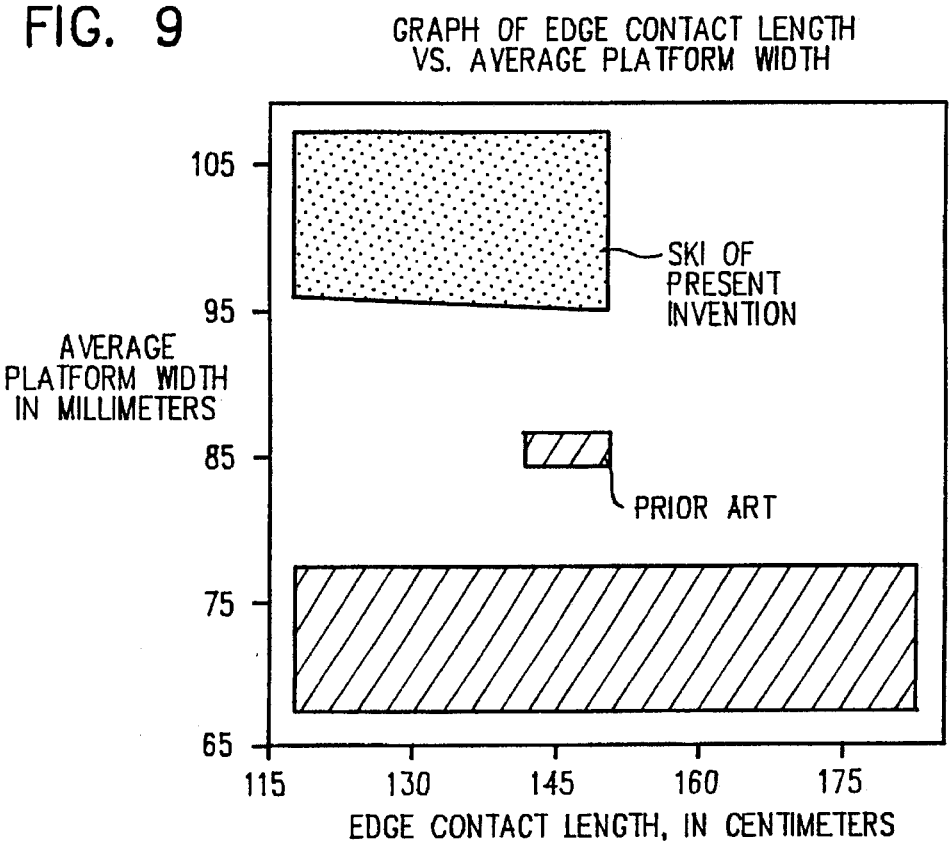
FIG. 9 is a graph plotting edge contact vs. average width for various skis.

FIG. 9, Graph of Edge Contact Length, in Centimeters vs. Average Width, in Millimeters.

This graph illustrates the difference in "feel" that the wide short ski has compared to the prior art skis referenced. An edge contact length lower limit of 117 cm is used for a cut off point for prior art comparisons. This 117 cm cut off length, plus a nominal 5 cm of heel length, and 18 cm of shovel length, for a total ski length of 140 cm, was referenced earlier in the specification by applicant as the lower limit of overall length for an adult recreational ski that retained the minimum industry accepted standard of length for directional stability. U.S. Pat. 4,007,946, Sarver, 1977, and U.S. Pat. No. 4,778,197, Floreani, 1988, are not shown in this graph, falling far short of this minimum length.

The area toward the top portion of the graph, which the wide short ski occupies, represents the area of maximum platform stability, approximating very closely the width range of the average adult human foot.

Toward the bottom portion of the graph, or area of lesser platform stability width, are plotted skis in their various ranges of cited dimensional criteria as discussed by U.S. Pat. No. 4,343,485, Johnston, et. al., 1982, U.S. Pat. 4,895,388, Richmond, 1990, short skis in use in the 1970's, and conventional width skis.

Figure 10:
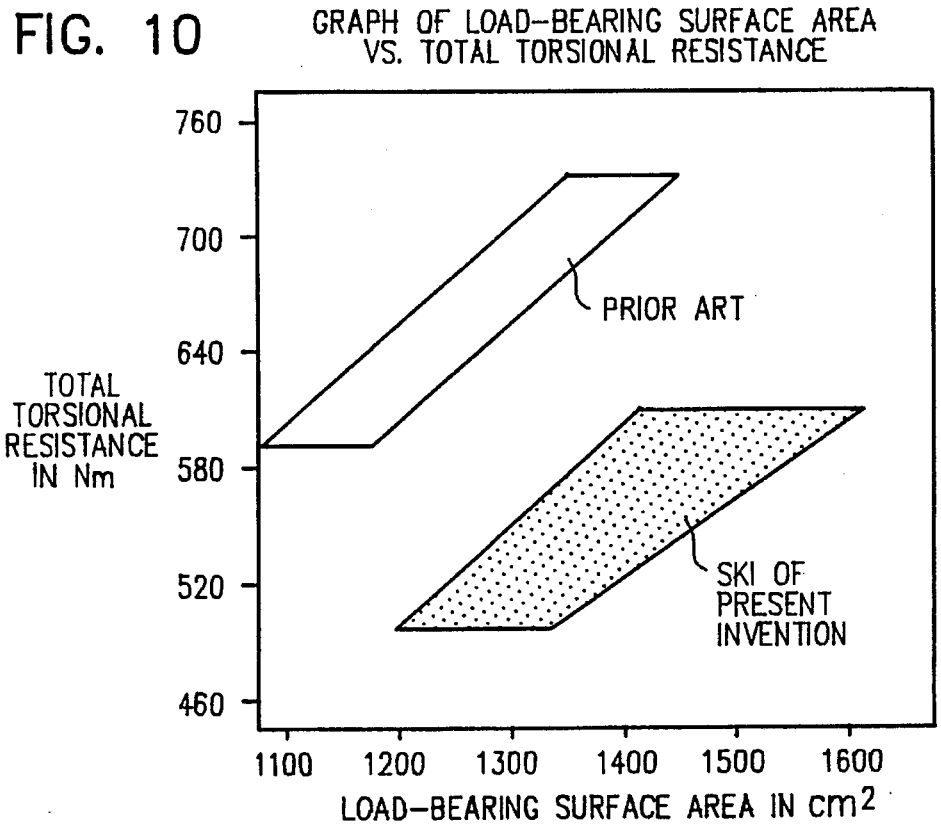
FIG. 10 is a graph plotting base contact area vs. total ski length for various skis.

FIG. 10, Graph of Load-Bearing Surface Area, in $cm^2$ vs. Torsional Resistance, or T, in Newtons.

As per the discussion concerning the minimum industry accepted standards for load-bearing surface area recited by applicant earlier in the specification, a 1100 $cm^2$ lower limit has been set as a criterion. U.S. Pat. 4,007,946, Sarver, 1977, and U.S. Pat. No. 4,778,197, Floreani, 1988, are not shown, falling far short of this minimum criterion.

Maximum mechanical advantage, and this maximum energy efficiency, is reached as one approaches the lower right hand corner of this graph. The wide short ski approaches the reasonable limit of mechanical advantage plotted in thus graph, occupying a unique area of low torque to load-bearing surface area ratio. As in FIG. 9, dimensions for all skis plotted are taken from their dimensional criteria cited in their respective patents, or taken from well-known industry accepted standards.

Figure 11:
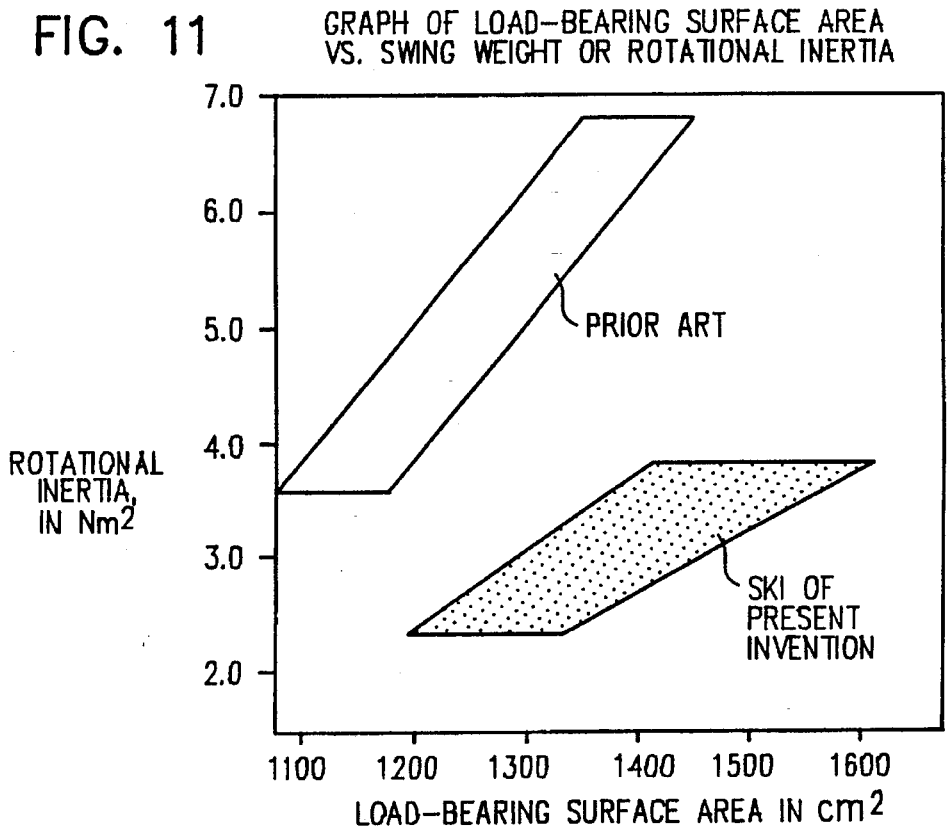
FIG. 11 is a graph plotting base contact area vs. swing weight for various skis.

FIG. 11, Graph of Load-Bearing Surface Area vs. Swing Weight or Rotational Inertia As has been previously discussed in the description of FIG. 11, a criterion for lower limit of load-bearing surface are for all skis represented on the graph of FIG. 11 of approximately 1100 $cm^2$ has been set. The load-bearing surface area for all skis plotted is given in centimeters squared. The swing weight, or rotational inertia $I_R$ is given in Newton meters squared for all skis plotted.

The area approached by the plotted values for the wide short ski, on the lower right hand corner of the graph, represents the area of this graph of maximum mechanical advantage, hence maximum energy efficiency.

The dimensional criteria used for plotting all skis represented on the graph are taken directly from their respective patents, or from well-known industry accepted standards. For calculating the mass of the skis represented, an industry average of 9 grams per centimeter of length is used for all skis, and converted into Newtons. As discussed previously, the load-bearing surface area of the skis plotted is a product of the ski's base contact length and its average width.

Skis designed along dimensional parameters as disclosed by U.S. Pat. No. 4,007,946, Sarver, 1977, or U.S. Pat. No. 4,778,197, Floreani, 1988, are not shown, falling far short of the approximate 1100 $cm^2$ load-bearing surface area lower limit criterion.

Figure 12:
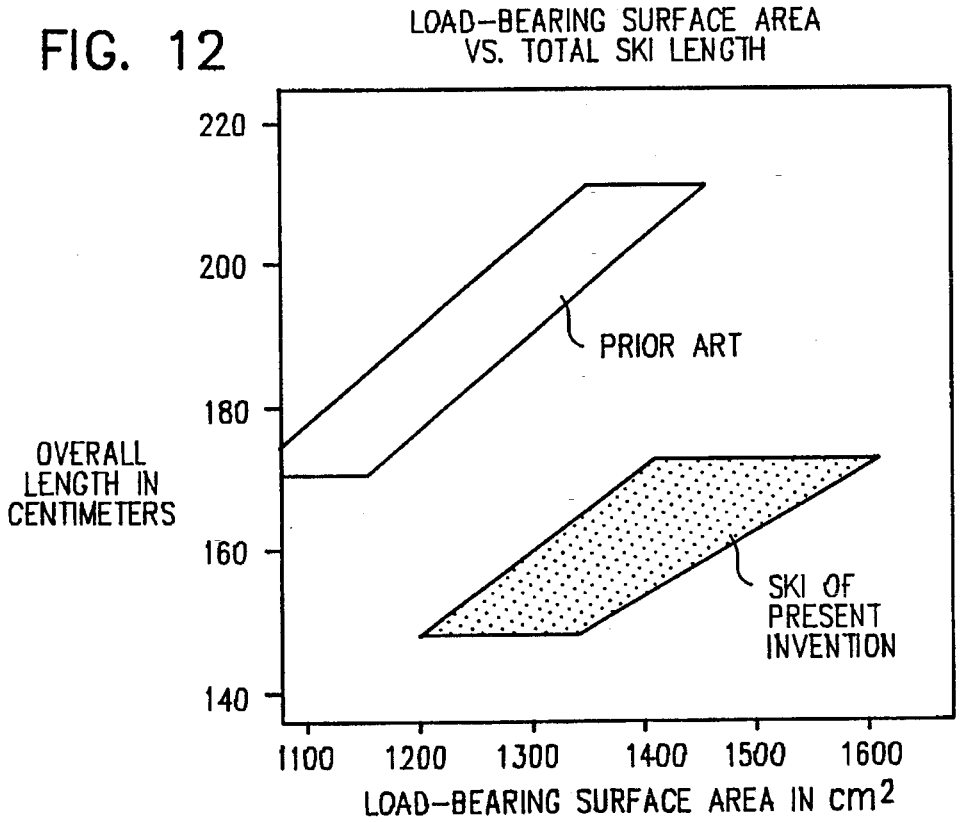
FIG. 12 is a graph plotting base contact area vs. total torsional resistance.

FIG. 12, Graph of Load-Bearing Surface Area vs. Total Ski Length.

As in the previously discussed graphs, the load-bearing surface area is given in centimeters squared, and the total ski length, including the heel and shovel is given in centimeters. This graph, in plotting the load-bearing surface area of various ski embodiments against overall length, gives another perspective of looking at the difference in "feel" that various skis have when compared to each other.

The overall ranges of length of the various skis represented on the graph of FIG. 12 are plotted to show, in a simplified manner, the importance that overall length plays as the major variable in determining the characteristics of both swing weight and torsional resistance, and hence ease of turn initiation.

In FIG. 12, the area of maximum mechanical advantage and hence maximum energy efficiency, is approached toward the lower right hand corner of the graph. Here, the obvious advantages of ease of turn initiation resulting from abbreviated overall length are advantageously combined with an optimum range of load-bearing surface area. „

The wide short ski occupies this area of the graph.

U.S. Pat. No. 4,007,946, Sarver, 1977, and U.S. Pat. No. 4,778,197, Floreani, 1988, are not shown on the graph in FIG. 12, falling far short of the industry accepted minimum load-bearing surface area criterion, as previously shown.

Conclusion, Ramifications and Scope of Invention

Thus the reader will see that the ski of the invention provides a highly energy efficient means of travel in a very broad range of snow conditions through a unique combination of dimensional criteria that produce maximum mechanical advantages.

While my above description contains many specific dimensions, these should not be construed as limitations on the scope of the invention, but rather as limited examples of but a few embodiments thereof. Many other variations are possible; however, it is believed that in all cases the dimensions should be maintained within the approximate ranges described. For example, the ski of the invention, while especially useful for older skiers, can be seen to be a useful tool, because of its inherent high energy efficiency for beginning adult skiers of any age to learn on. The ski of the invention would also be useful to experienced, younger skiers who wish to conserve energy, if skiing deep, heavy powder snow all day, where the physical exertion required in turning is quite taxing even to those young and fit. Accordingly, the scope of the invention should be determined not by the embodiments illustrated, but by the appended claims which follow, and their legal equivalents.

I claim:

1. A wide short snow ski, for use in a pair, comprising:

a forward shovel portion having a maximum transverse width in the range of approximately 110 to 120 millimeters, and a rearward, tail portion having a maximum transverse width in the range of approximately 105 to 115 millimeters, and wherein said shovel portion has a rearwardly tapering region and said tail portion has a forwardly tapering region, said rearwardly and forwardly tapering regions coming together to define a waist portion of said ski, said waist portion having a transverse width that is less than the maximum transverse width of said shovel and tail portions, respectively, and further, said shovel, waist and tail portions defining the total length of said ski, said ski length being within the range of about 148 and 173 centimeters, and further, said shovel portion includes a tip curving upwardly from a forward location on said shovel portion, and said tail portion has an end curving upwardly from a rearward location on said tail portion, and further, said ski has an upward camber substantially between said forward and rearward locations, and still further, said rearwardly and forwardly tapering regions of said shovel and tail portions, respectively, are geometrically defined by symmetric, concave arcs, wherein the arc of curvature of each one of said arcs is defined by a sidecut radius within the range of approximately 14 meters to 28 meters, said arcs defining the transverse width of said waist portion, said ski further including reinforcing at said waist portion for purpose of mounting bindings, whereby within said width and length ranges, in combination with said range of sidecut radii, and the flotation provided by the area bounded by said ranges of said widths, said lengths and said sidecut radii, less physical force is required in overcoming the torsional resistance associated with making turns.

2. The ski of claim 1, wherein:

said sidecut radius is in the range of about 10 to 16 times said ski length.

3. The ski of claim 1, wherein:

the ski is bounded by said concave arcs within said range of sidecut radii, and further bounded at the ends of said arcs in the regions where said shovel and tail widths are at their greatest, said shovel and tail widths falling within said ranges of claim 1, the area of said flotation is in the range of approximately 1200 centimeters squared and 1600 centimeters squared.

* * * * *